US007572179B2

(12) United States Patent
Choi et al.

(10) Patent No.: US 7,572,179 B2
(45) Date of Patent: Aug. 11, 2009

(54) VENTILATION SYSTEM

(75) Inventors: Dong Hwan Choi, Busan-si (KR); Kyung Hwan Kim, Kyunggi-do (KR); Nam Sik Yim, Seoul (KR); Ho Seon Choi, Seoul (KR); Keun Hyoung Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 31 days.

(21) Appl. No.: 11/558,990

(22) Filed: Nov. 13, 2006

(65) Prior Publication Data

US 2007/0155303 A1 Jul. 5, 2007

(30) Foreign Application Priority Data

Nov. 14, 2005 (KR) ..... 10-2005-0108786

(51) Int. Cl.
*F24F 12/00* (2006.01)
*F24F 13/20* (2006.01)
*F24F 3/14* (2006.01)

(52) U.S. Cl. ..... 454/241; 454/237; 454/249; 454/251; 454/252; 165/8; 165/54

(58) Field of Classification Search ..... 454/237, 454/241, 244, 248, 251, 252, 249; 165/8, 165/222, 54
See application file for complete search history.

(56) References Cited

U.S. PATENT DOCUMENTS 4,113,004 A 9/1978 Rush et al.
4,180,126 A * 12/1979 Rush et al. ..... 165/59
5,193,610 A * 3/1993 Morissette et al. ..... 165/54
5,372,182 A * 12/1994 Gore ..... 165/7
5,485,878 A * 1/1996 Derks ..... 165/248
5,660,228 A * 8/1997 Steege et al. ..... 165/76
6,209,622 B1 * 4/2001 Lagace et al. ..... 165/8
6,575,228 B1 * 6/2003 Ragland et al. ..... 165/54
6,622,508 B2 * 9/2003 Dinnage et al. ..... 62/271
6,889,750 B2 * 5/2005 Lagace et al. ..... 165/8
2002/0129614 A1 9/2002 Dinnage et al.
2005/0260946 A1 11/2005 Kim
2006/0180295 A1 8/2006 Lee et al.
2006/0199511 A1 9/2006 Chung et al.
2006/0199512 A1 9/2006 Lee et al.
2006/0254749 A1 11/2006 Kim et al.

(Continued)

FOREIGN PATENT DOCUMENTS

CN 2425316 3/2001

(Continued)

OTHER PUBLICATIONS

English Language Abstract of JP 2002-147794.

(Continued)

*Primary Examiner*—Steven B McAllister
*Assistant Examiner*—Patrick F. O'Reilly, III
(74) *Attorney, Agent, or Firm*—McKenna Long & Aldridge LLP

(57) ABSTRACT

A ventilation system includes a ventilation module having a heat exchanger module, an IAQ module for improving quality of air passing through the ventilation module, and a case for guiding the air that consecutively passes through the ventilation module and the IAQ module.

7 Claims, 11 Drawing Sheets

U.S. PATENT DOCUMENTS

2006/0269440 A1 11/2006 Lee et al.

FOREIGN PATENT DOCUMENTS

| | | | | |
|---|---|---|---|---|
| EP | 1722169 | | | 11/2006 |
| GB | 2280951 | A | * | 2/1995 |
| JP | 58164941 | A | * | 9/1983 |
| JP | 58179745 | A | * | 10/1983 |
| JP | 2002-147794 | | | 5/2002 |
| JP | 2002-147803 | | | 5/2002 |
| WO | 01/79763 | | | 10/2001 |

OTHER PUBLICATIONS

English Language Abstract of JP 2002-147803.

* cited by examiner

VENTILATION SYSTEM

BACKGROUND OF THE INVENTION

1. Field of the Invention

The present invention relates to a ventilation system, and particularly, to a ventilation system that can perform massive ventilation. More particularly, the present invention relates to a ventilation system, in which each function for performing an air conditioning function is formed in a module type so that the installing convenience and comfortableness can be improved.

2. Description of the Related Art

Recently, the people have had a great interest in health. Particularly, there is a significant desire for a comfortable indoor environment where people are living. The comfortableness of the indoor environment is generally realized by the air condition process. However, there is a limitation in improving the indoor environment. Therefore, a ventilation system that can introduce fresh external air and exhaust indoor air has been spotlighted. The ventilation system is a system that can freshly maintain an indoor air by allowing for a heat exchange between outgoing air and incoming air without making them mixed with each other.

That is, the ventilation system can achieve an object that cannot be achieved by a general air conditioner that can control only the temperature and humidity. Namely, the ventilation system exhausts micro dusts, viruses, chemical materials, and the like together with outgoing air while allowing for the incoming of the external fresh air.

The ventilation system is generally designed considering the following factors.

First, the ventilation system has to have a sufficient ventilation volume and prevent foreign objects such as rain water or dust from being introduced through an air inlet and an air outlet. In addition, the ventilation system is designed not to be affected by external air current. The exhaust air must not be re-entered into the indoor space. The indoor heat must not be lost. The installation of the ventilation system can be easily realized.

The present invention particularly relates to the ventilation volume among the above-described factors.

The conventional ventilation system can obtain massive ventilation. However, it has the following problems.

First, the indoor temperature can be constantly maintained by using a heat exchanger. However, the humidity of the indoor space cannot be properly maintained. Therefore, an additional humidifier or dehumidifier is required. That is, the conventional ventilation system simply performs the ventilation function but cannot actively improve the indoor air quality.

Furthermore, since the air flow passage is complicated, the airflow resistance and the noise caused by he airflow resistance increase.

SUMMARY OF THE INVENTION

Accordingly, the present invention is directed to a ventilation system that substantially obviates one or more problems due to limitations and disadvantages of the related art.

An object of the present invention is to provide a ventilation system having a module that can control the indoor humidity.

Another object of the present invention is to provide a ventilation system that can be operated under a variety of operation conditions by reducing the air flow resistance even though there is some reduction in the ventilation performance.

Still another object of the present invention is to provide a ventilation system in which components are formed in module types so that the selective installation thereof can be easily performed.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a ventilation system including: a ventilation module having a heat exchanger module; an IAQ (indoor air quality) module for improving quality of air passing through the ventilation module; and a case for guiding the air that consecutively passes through the ventilation module and the IAQ module.

In another aspect of the present invention, there is provided a ventilation system including: an air exhaust fan for exhausting polluted indoor air to an outdoor side; an air supply fan for supplying outdoor air into an indoor space; a barrier rib for dividing a space where the air supply fan is disposed and a space where the air exhaust fan is disposed, the barrier rib being provided with a circulation hole through which a portion of the indoor air that is being discharged is returned to the space where the air supply fan is disposed; and an heat exchanger module disposed in rear of the air exhaust and supply fans.

In still another aspect of the present invention, there is provided a ventilation system including: a ventilation module receiving at least a heat exchanger module; and an IAQ module receiving a dehumidifier module and a filter module for improving quality of air passing through the ventilation module, wherein the dehumidifier module or the filter module are independently mounted or dismounted.

By the above-described present invention, the indoor humidity can be actively controlled. The ventilation system can be operated under a variety of conditions.

Since the components are formed in module types, the selective installation thereof can be easily performed and thus the product application of the ventilation system can be more convenient.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

FIRST EMBODIMENT

Figure 1:
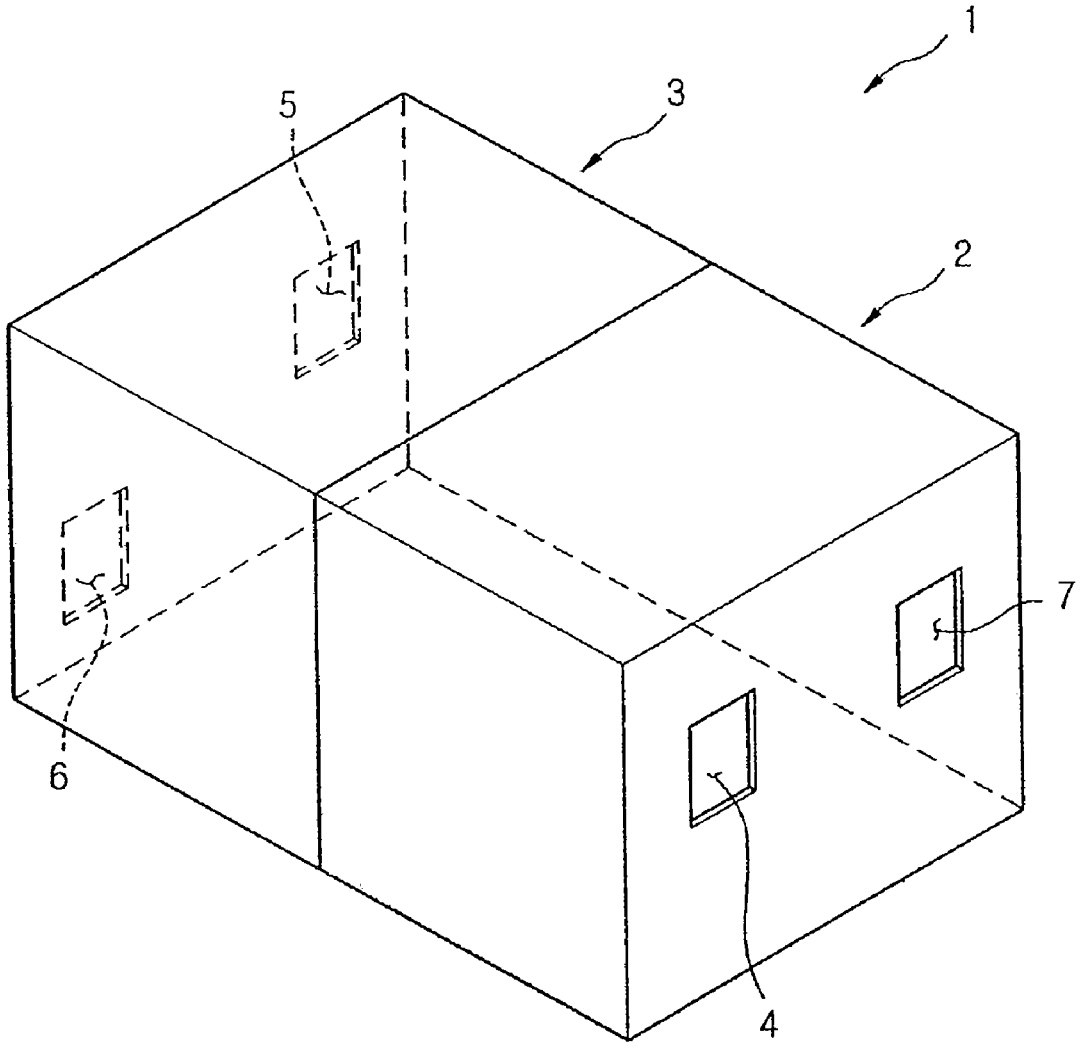
FIG. 1 is a perspective view of a ventilation system according to an embodiment of the present invention.

FIG. 1 is a perspective view of a ventilation system according to an embodiment of the present invention.

Referring to FIG. 1, a ventilation system 1 includes a case, a ventilation module 2 protected by the case and disposed at a side of the ventilation system, and an IAQ module 3 disposed at another side of the ventilation module.

As the ventilation module 2 and the IAQ module 3 are horizontally arranged in parallel, the user can conveniently replace each component of the IAQ module 3 and efficiently use the indoor space.

Meanwhile, a fan and an electric heat exchanger are provided in the ventilation module 2 to forcedly circulate the indoor air. The circulating air is heat-exchanged by the electric heat exchanger to maintain a temperature of the indoor air.

In addition, a humidifier or a dehumidifier may be disposed in the IAQ module 3 to control the humidity of the indoor air.

In addition, the ventilation system 1 is provided with an air inlet/outlet portions through which the indoor and outdoor air is introduced and exhausted. That is, the air inlet/outlet portions include an air supply inlet 6 through which an outdoor air is introduced, an air supply outlet 7 through which the outdoor air introduced is discharged to the indoor space, an air exhaust inlet 4 through which the indoor air is introduced, and an air exhaust outlet 5 through which the indoor air introduced is exhausted to an outdoor side. Ducts are connected to the respective air inlet/outlet portions to guide the air introduction and exhaust.

Figure 2:
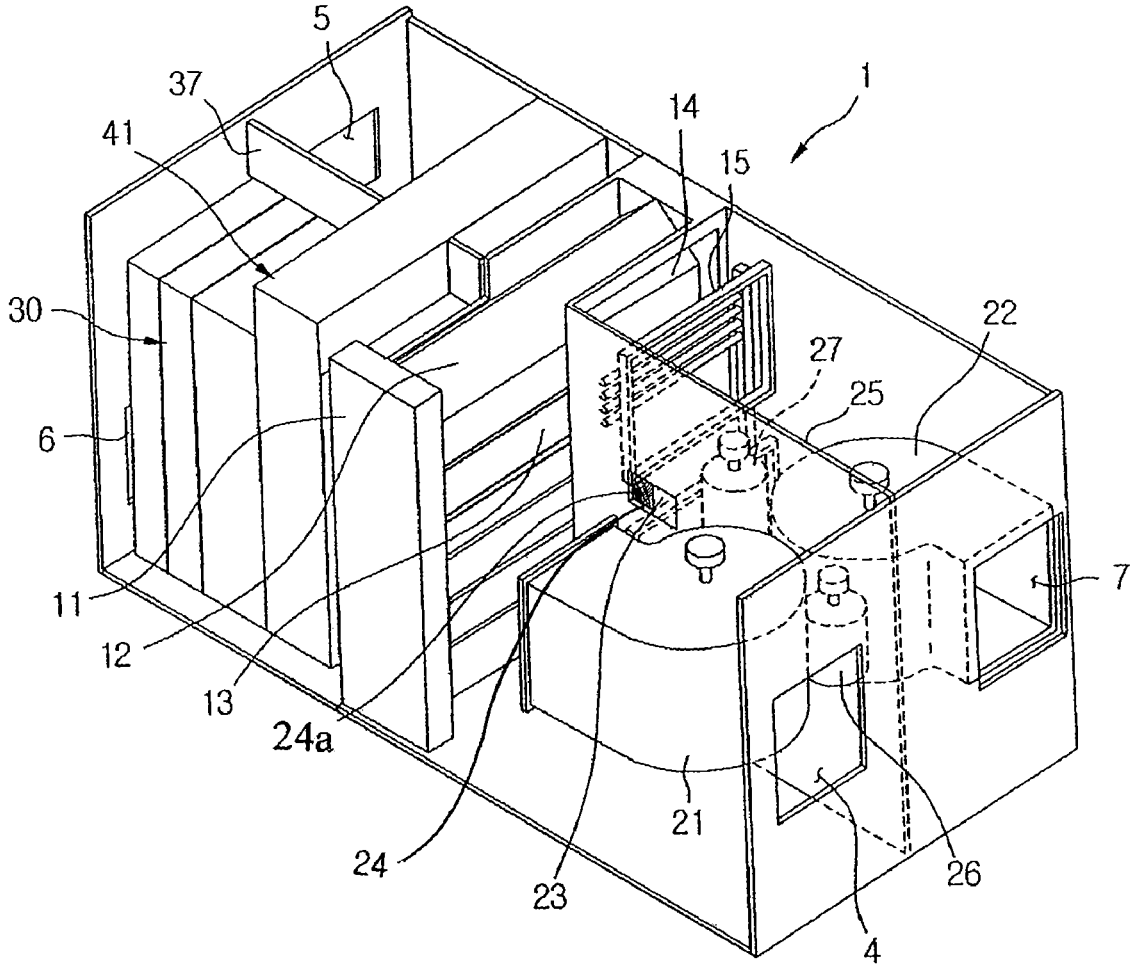
FIG. 2 is a perspective view of an internal structure of a ventilation system according to an embodiment of the present invention.

FIG. 2 is a perspective view of an internal structure of the ventilation system.

Referring to FIG. 2, the ventilation module is provided with a first space for receiving an exhaust fan 21 and a second space for receiving a supply fan 22. The first and second spaces are divided by a first blower barrier 25. Motors 27 and 26 for driving the respective supply and exhaust fans 22 and 21 are installed in the ventilation module 2.

A circulation hole 24 is provided at a predetermined location of the first blower barrier 25. The first space communicates with the second space through the circulation hole 24 so that a part of the air directed into the first space bypasses to the second space. The opening of the circulation hole 24 is controlled by a damper 23. Since the opening of the circulation hole 24 is adjusted by the damper 23, a preset amount of the air directed into the first space can bypass to the second space. That is, a part of the indoor air that is being discharged is mixed with the outdoor air that is being introduced. Therefore, an amount of the air discharged to the indoor space increases and a phenomenon where the supply fan 22 is overloaded can be prevented. That is, when the motor is overloaded, the damper 23 can be opened for a moment to prevent the malfunctioning of the device.

In addition, when an additional filter member 24A is further installed in the circulation hole 24, the ventilation system can function as an air conditioner. In this case, a part of the air supplied to the indoor space is air introduced from the outdoor and the rest of the air is air that is being exhausted out of the indoor space. The air that is being exhausted is purified while passing through the filter member.

In a downtown where the air contains a specific component such as ozone, it may be preferable that a part of the indoor air is purified and reused rather than the air being supplied is totally the outdoor air. At this point, the circulation hole 24 can be effectively used.

In addition, the heat exchanger module 11 is disposed in the rear of the fans 21 and 22. The heat exchanger module 11 includes a plurality of heat exchangers 12 stacked on one another and an exhaust side blocking layer 13 and a supply side blocking layer 14, which can selectively connect the exhaust fan 21 and the supply fan 22 to the heat exchangers 12 to separate the supply air and the exhaust air from each other.

The outdoor air that is being introduced passes through one of channels formed by stacking the heat exchangers 12. The indoor air that is being exhausted flows along a layer adjacent to the layer along which the outdoor air passes. As a result, the indoor and outdoor airs are heat-exchanged without being mixed with each other.

Figure 4:
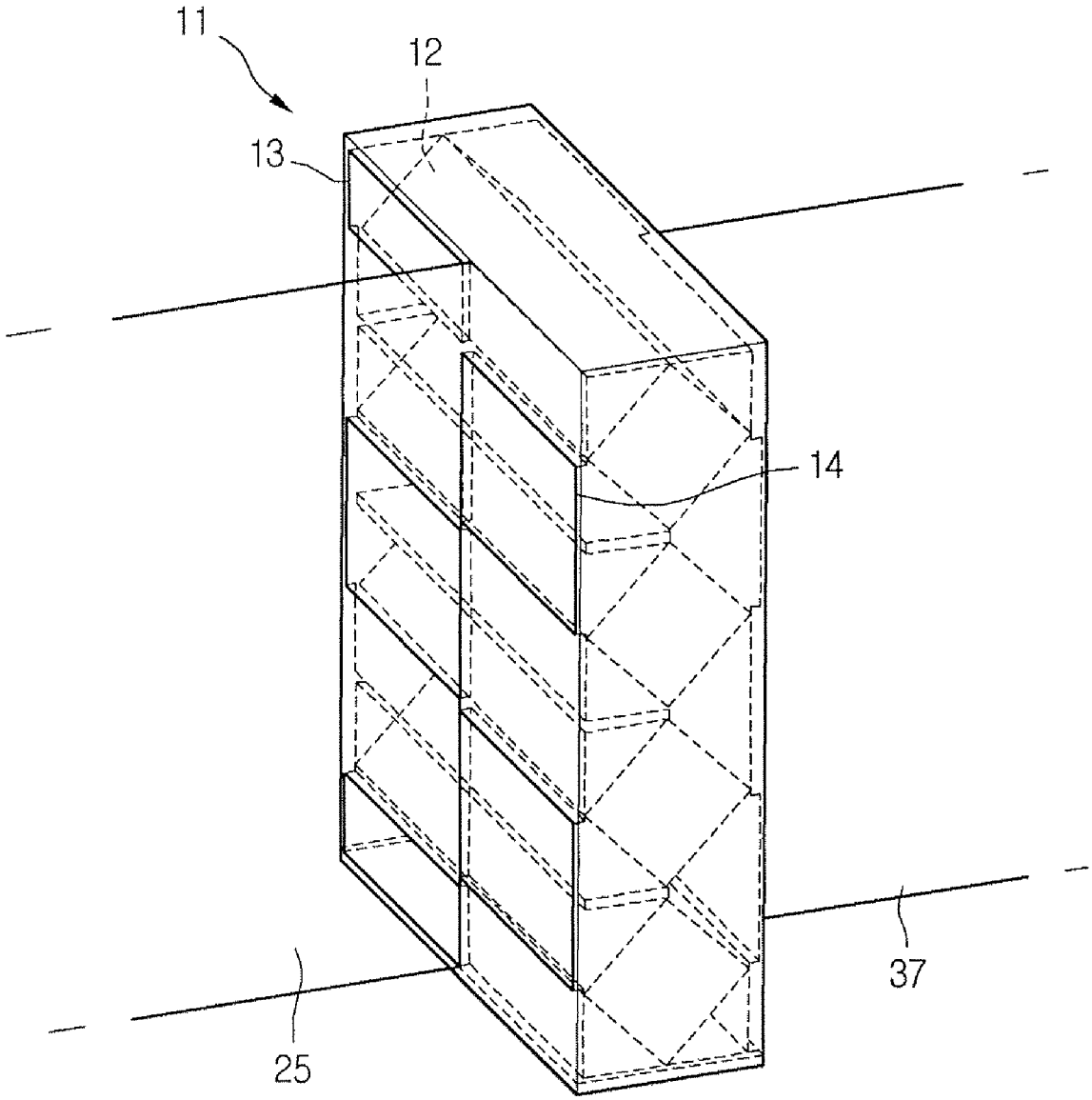
FIG. 4 is a perspective view of an electric heat exchanging module according to an embodiment of the present invention.

FIG. 4 is a perspective view of the heat exchanger module. Referring to FIG. 4, the heat exchanger module 11 includes the heat exchangers 12 stacked one on another. The supply side blocking layer 14 and the exhaust side blocking layer 13 are respectively provided on the front and rear surfaces of the heat exchanger 12 so that the indoor air and the outdoor air flow through specific layers of the heat exchangers 12 while being separated from each other. By the first and second blower barriers 25 and 37 that are respectively provided in front and in rear of the heat exchanger 12, the air flow direction is divided into a supply direction and an exhaust direction with respect to the electric heat exchanger 12.

The exhaust and supply blocking layers 13 and 14 are provided to guide the flow of the supply air and the exhaust air. As far as they function to guide the airflow, they can be designed in any shape. Therefore, the detailed description thereof will be omitted herein.

Referring back to FIG. 2, a humidifier module 15 is further provided at the inlet side of the air supply fan 22. The humidifier module 15 is a module for adding moisture to the air. It is generally used in winter and fall seasons.

The following will describe the IAQ module 3 in more detail.

The IAQ module 3 functions to improve the indoor air quality. That is, the IAQ module 3 functions to improve the humidity quality of the air and the purity of the air. In order to prevent the supply air and the exhaust air from being mixed with each other, a second blower barrier 37 is arranged at a central portion lengthwise.

The IAQ module 3 includes a filter module 30 for filtering off the foreign objects contained in the air and a dehumidifier module for reducing the humidity when a large amount of moisture is contained in the air.

Figure 3:
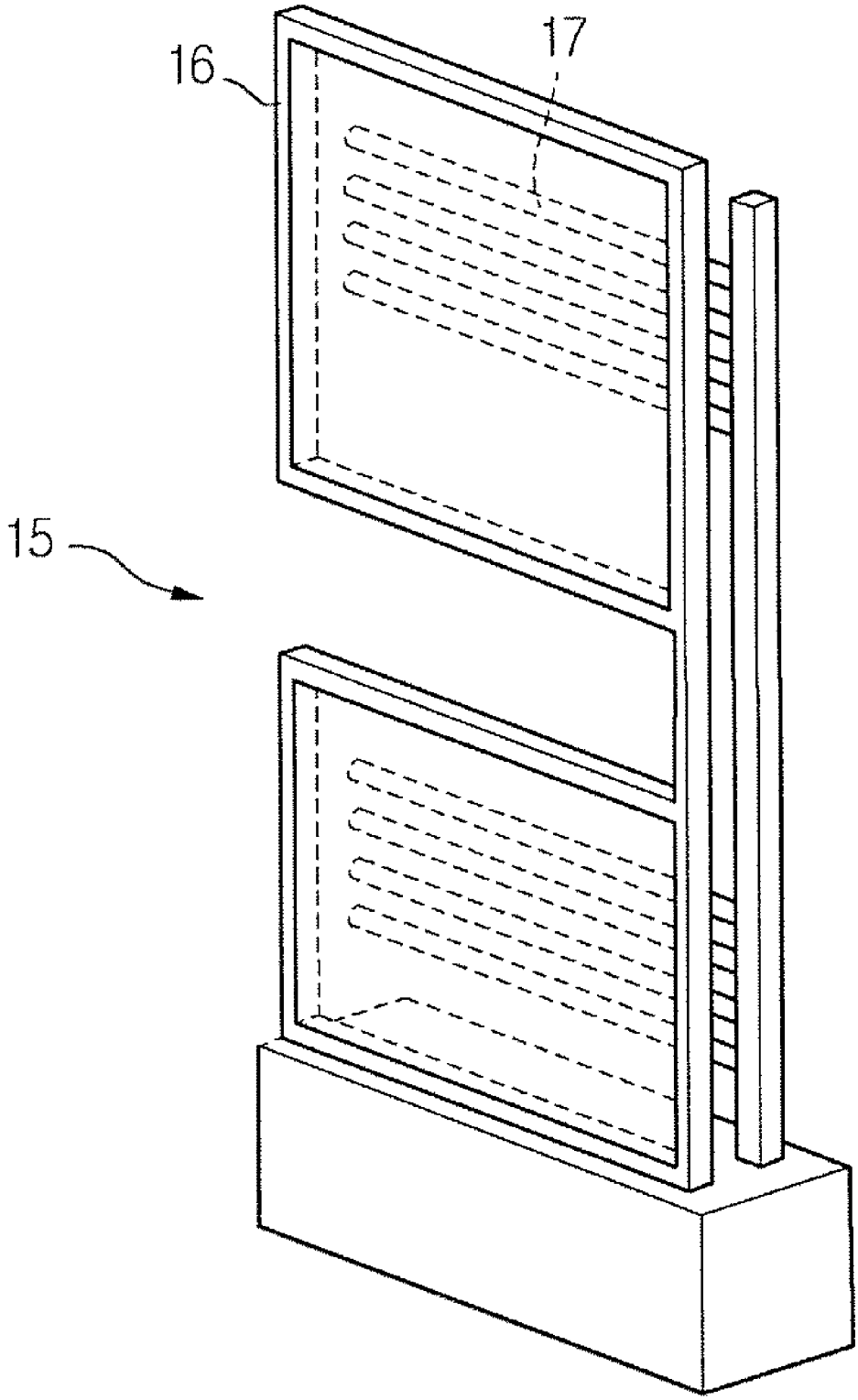
FIG. 3 is a perspective view of a humidifying module according to an embodiment of the present invention.

FIG. 3 is a perspective view of a humidifier module according to an embodiment of the present invention. Referring to FIG. 3, a sprayer 17 for spraying water and a humidifying net 16 sucking the sprayed water and vaporizing the sucked water are provided. The humidifier net 16 allows the water to be returned to the water reserving side.

Figure 5:
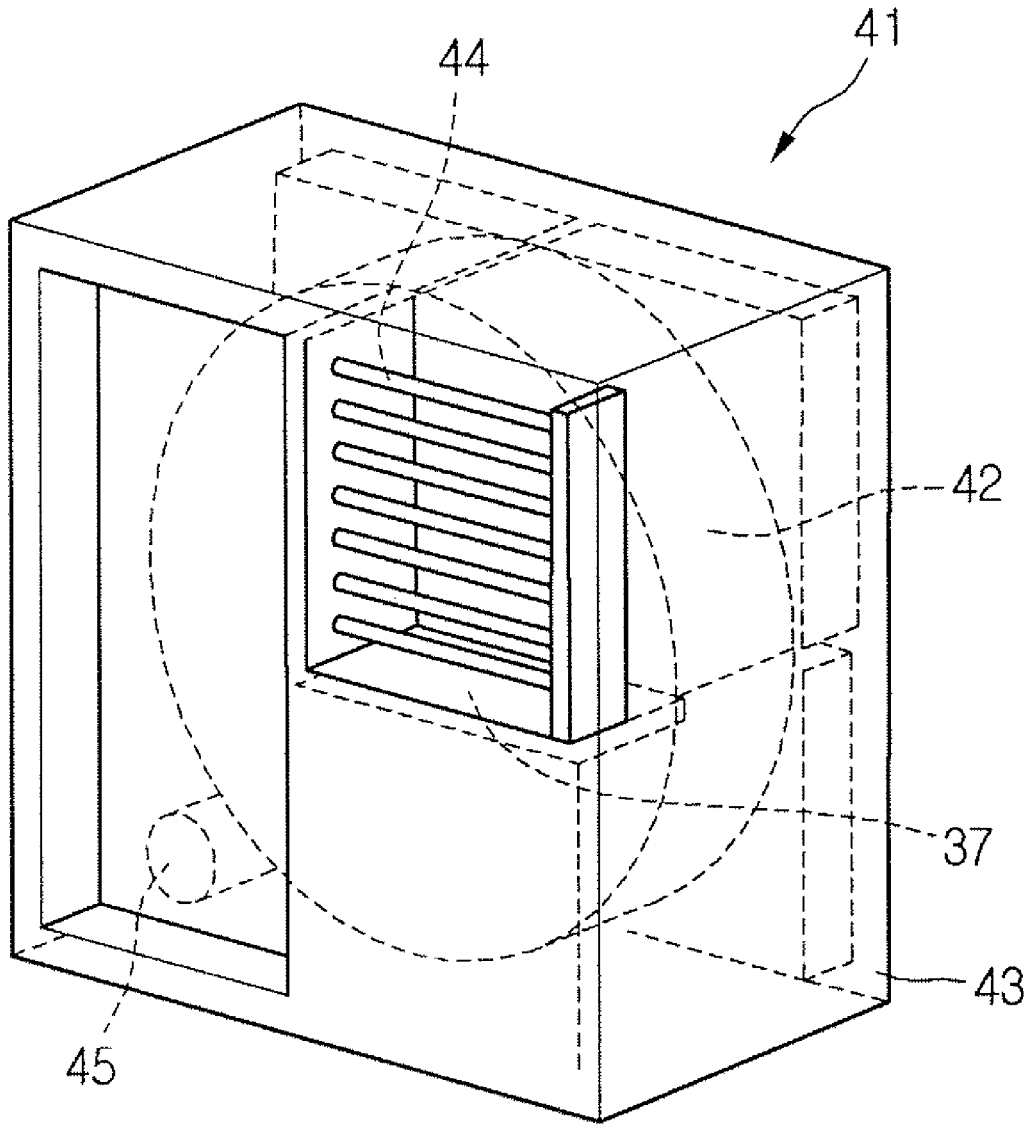
FIG. 5 is a perspective view of a dehumidifying module according to an embodiment of the present invention.

FIG. 5 is a perspective view of a dehumidifying module according to an embodiment of the present invention. Referring to FIG. 5, the dehumidifier module includes a housing 43, and a desiccant 42 received in the housing 43 and rotated by a motor 45.

The desiccant 42 is divided into a region for absorbing the moisture and a region for vaporizing the moisture. The moisture absorbing region is provided on a path through which supply air passes. The moisture vaporizing region is provided on a path through which exhaust air passes. In the moisture vaporizing region, a heat 44 is disposed to apply heat by which the moisture in the relevant region of the desiccant 42 is vaporized.

Figure 6:
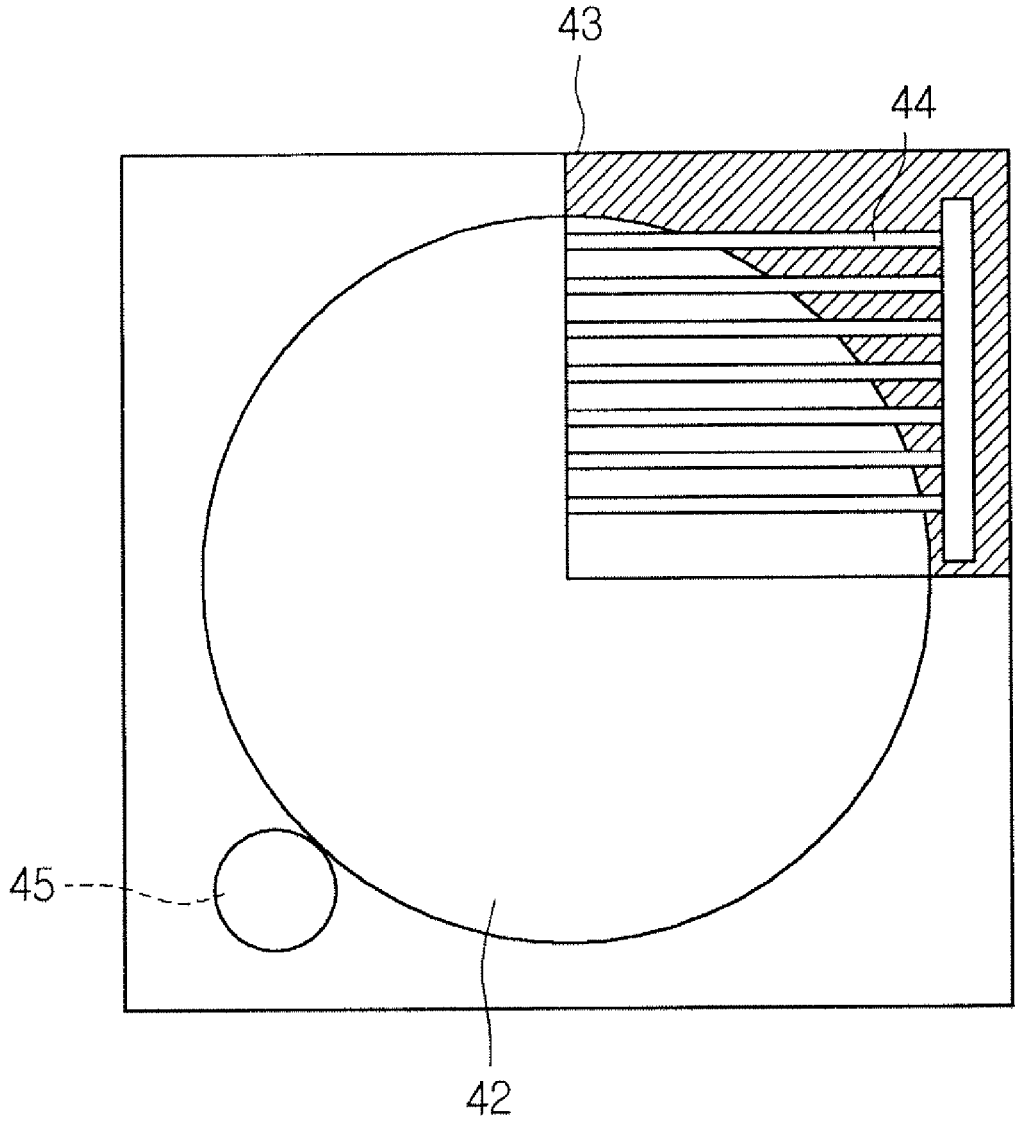
FIG. 6 is a schematic top plane view of a dehumidifying module according to an embodiment of the present invention.

FIG. 6 is a schematic front view of the dehumidifier module. Referring to FIG. 6, it can be easily noted that a left side of the housing 43 is aligned with a supply passage 46 and a right upper side of the housing 43 is aligned with an exhaust passage 47. Before the air flowing along the exhaust passage 47 reaches the desiccant 42, the air is primarily heated by the heater 44. Therefore, after the moisture of the desiccant 42 is vaporized by the heat generated by the heater 44, the air is exhausted to the outdoor side.

Meanwhile, the desiccant 42 may be generally formed with a circular section so that it can rotate. Meanwhile, the housing 43 may be generally designed with a rectangular section. In this case, a portion of the exhaust passage 47, which is not covered by the desiccant 42, is maintained in an opened state. By doing this, some of the air passing through the dehumidifier module 41 bypasses. The passage is defined by a bypass area represented by hatching line in FIG. 6.

By the bypass area, a portion of the air exhausted by the exhaust fan 21 contacts a heating portion of the desiccant 42, and the rest bypasses to the bypass area portion. Therefore, the overload of the exhaust fan 21 can be prevented. As the air heated by the heater 44 is applied to the desiccant 42, the moisture absorbed in the desiccant 42 can be vaporized.

Figure 7:
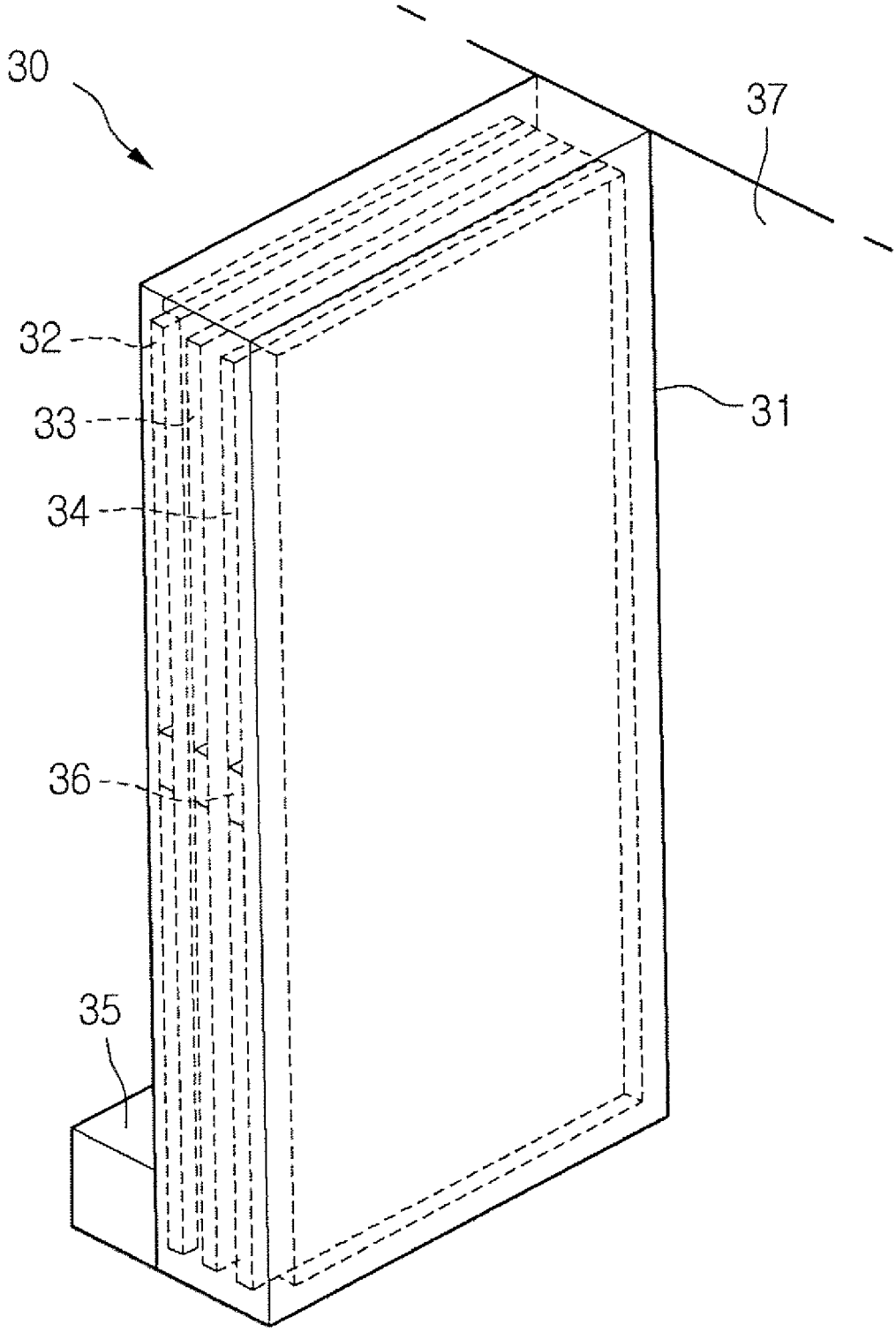
FIG. 7 is a perspective view of a filter module according to an embodiment of the present invention.

FIG. 7 is a perspective view of a filter module according to an embodiment of the present invention.

Referring to FIG. 7, the filter module 30 is disposed on an air supply passage with reference to the second blower barrier 37 to filter off the foreign objects contained in the air being supplied. To realize this, the filter module 30 is designed to have a rectangular section. In order to mount and dismount the filter module 30, first, second and third filters 32, 33, 34 are selectively mounted in a filter housing 31. Spacers 36 are disposed between the filters so that the mounting and dismounting of the filters can be effectively realized.

Furthermore, in order to remove viruses contained in the air, a sterilizer 35 may be provided.

The dehumidifier module 41 and the filter module 30 may be supported by a housing. Each module can be independently mounted or dismounted. By this structural property, if the dehumidifier and the filter module are not necessary, they can be moved without affecting other modules.

That is, since the modules can be added or removed according to a user's wanting, the manufacturer can add a specific module the user wants and remove another module the user does not want. Therefore, the ventilation system on demand can be supplied to the user.

Figure 8:
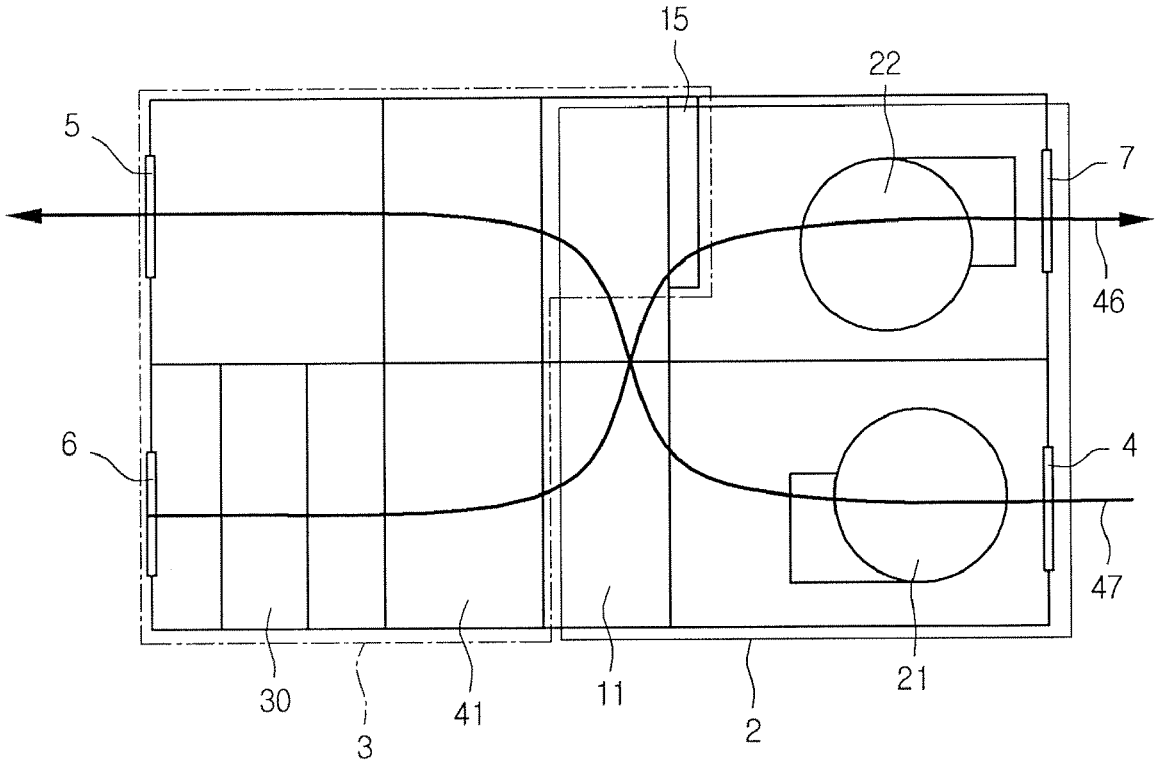
FIG. 8 is a horizontal arrangement view of a ventilation system, illustrating the operation of the ventilation system.

FIG. 8 is a horizontal arrangement view of the ventilation system, illustrating the operation of the ventilation system.

Referring to FIG. 8, the indoor air introduced through the exhaust fan 21 is heat-exchanged by the electric heat exchanger module 11 and then exhausted to the outdoor with the moisture while passing through the dehumidifier module 41.

For the air supplied to the indoor space, the outdoor air is introduced and purified by the filter module 30 and moisture contained in the outdoor air is removed by the dehumidifier module 41. Then, the air is heat-exchanged by the electric heat exchanger module 11 and then humidified by the humidifier module 15. The humidifier air is discharged to the indoor space by the air supply fan 22.

Here, the exhaust fan 21 sends the air to the IAQ module 3 in an air pushing manner and the air supply fan 22 sucks the air from the IAQ module 3 in an air suction manner. As described above, the reason for the difference of the air flowing manner is to gather the air supply fan and the air exhaust fan at an identical side of the IAQ module 3, thereby simplifying the structure of the ventilation system and minimizing the flow resistance of the air.

In addition, the ventilation system can operate in a state where only the ventilation module is mounted without using the humidifier module, dehumidifier module, and filter module. This structure is shown in FIG. 9.

Figure 9:
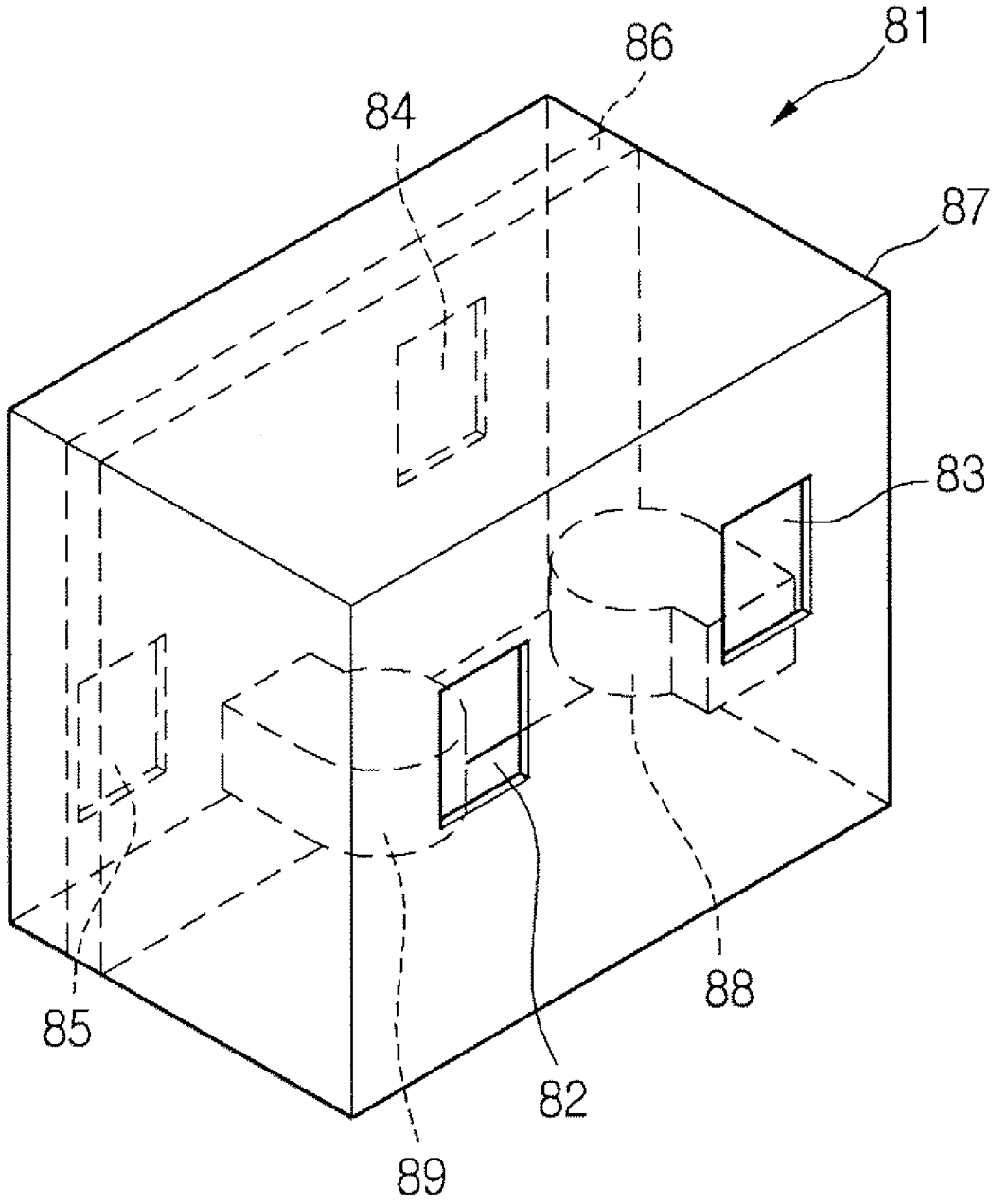
FIG. 9 is a schematic view of a ventilation system, when an IAQ module is removed from the ventilation system.

FIG. 9 is a schematic view of the ventilation system, when the IAQ module is removed from the ventilation system.

Referring to FIG. 9, the ventilation system 81 not having the IAQ module includes a case 87, a supply fan 88 mounted on a right hand side of the case 87, an exhaust fan 89 mounted on a left side of the case 87, and a heat exchanger 86 mounted on a right side of the case 87. By this simple structure, the ventilation system can be sufficiently operated. In this state, a variety of required modules can be added according to the selection of the user. Furthermore, the mounting and dismounting of the modules can be easily realized. This is the most strong point of the present invention.

The reference numerals 84, 85, 82, and 83 that are not described above respectively indicate an air exhaust outlet, an air supply outlet, an air exhaust inlet, and an air supply outlet.

SECOND EMBODIMENT

A second embodiment of the present invention is identical to the first embodiment except that a structure and mounting location of the ventilation module 101 is different. Therefore, the description of the like parts will quote the first embodiment.

Figure 10:
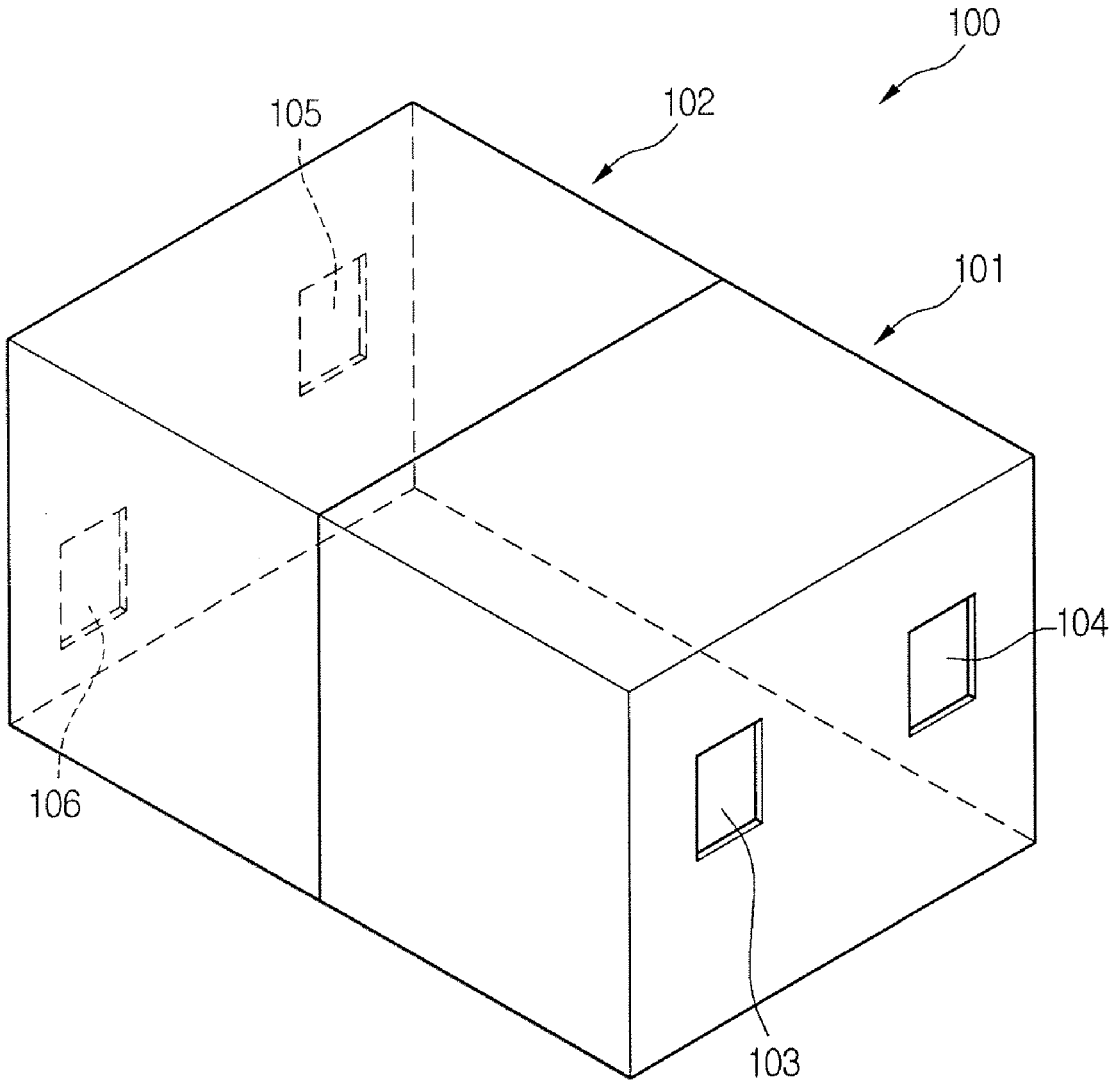
FIG. 10 is a perspective view illustrating an outer appearance of a ventilation system according to a second embodiment of the present invention.
Figure 11:
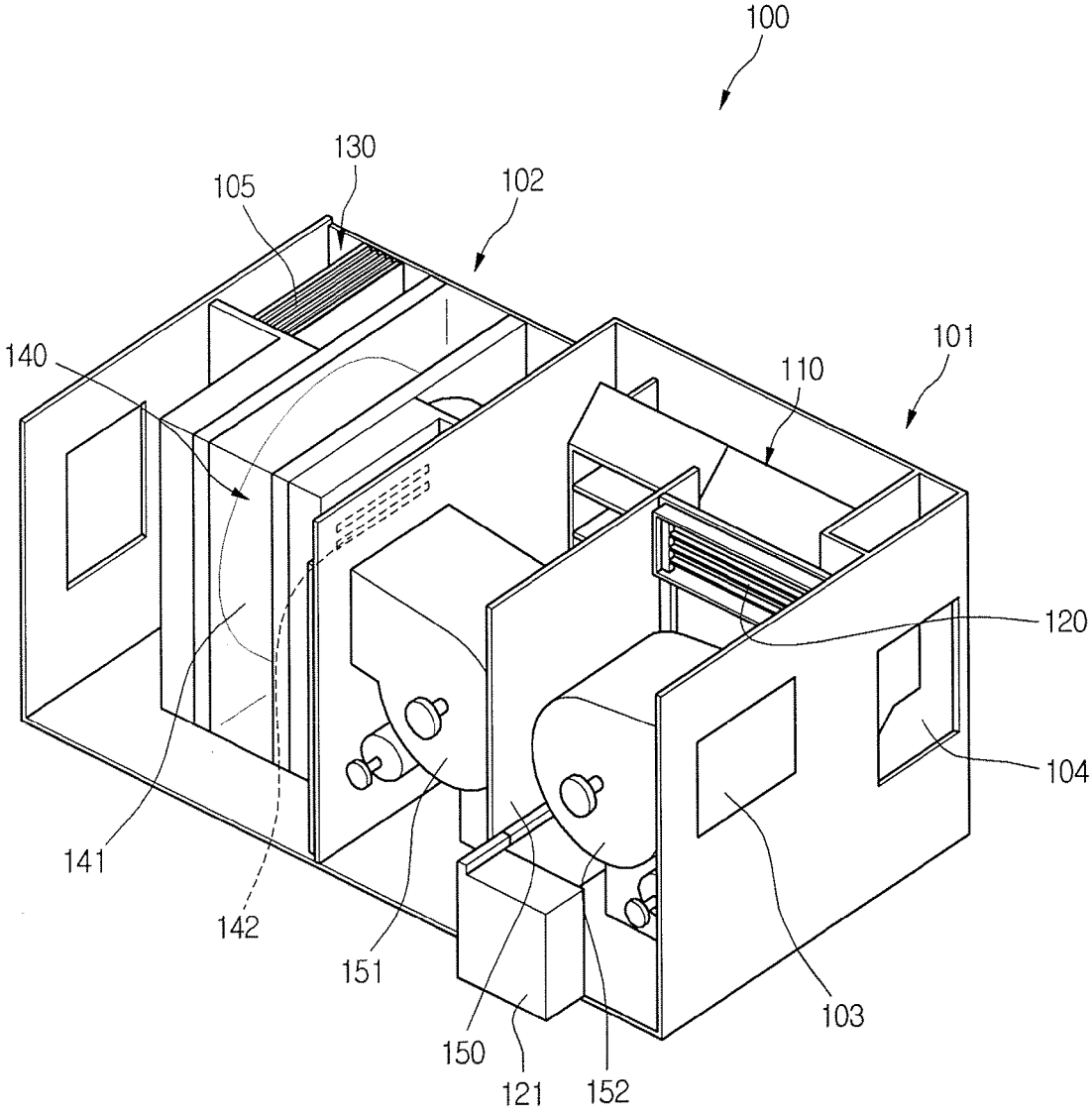
FIG. 11 is a perspective view of an internal structure of the ventilation system of FIG. 10.

FIG. 10 is a perspective view illustrating an outer appearance of a ventilation system according to a second embodiment of the present invention.

Referring to FIG. 10, a ventilation system 100 of this embodiment includes a ventilation module 101 and an IAQ module 102. An air exhaust inlet 104 and an air supply outlet 103 are formed in front of the ventilation module 101. An air supply inlet 105 and an air exhaust outlet 106 are formed in rear of the IAQ module 102.

An air supply fan 152 and an air exhaust fan 151 are disposed in the ventilation module 101. In addition, an electric heat exchanger module 110 is disposed in rear of the fans 151 and 152. A humidifier module 120 is disposed at a portion through which the electric heat exchanger module 110 communicates with the air supply fan 152. A water reserving tank 121 for supplying water to the humidifier module 120 is disposed at a side of the ventilation module 101.

The contact of the air supply fan 152 and the air exhaust fan 151 with the electric heat exchanger 110 is designed such that the air flow passage can guided by each blocking layer. The detailed description of this will be omitted herein.

In addition, a dehumidifier module 140 and a filter module 130 are installed in the IAQ module 102 and a desiccant 141 and a heater 142 are provided on the dehumidifier module 140.

According to this second embodiment, an arrangement of the components that are constituent elements of the ventilation module 101 is changed. That is, the air supply fan 152 is aligned with the air supply outlet 103 but the air exhaust fan 151 is not directly aligned with the exhaust air inlet 104. That is, the air exhaust fan 151 is aligned with the air exhaust inlet 104 via the heat exchanger module 110. In addition, the heater 142 is directly aligned with the air exhaust fan 152. A partition 150 is provided between the exhaust fan and the supply fan.

According to this embodiment, since the electric heat exchanger module 110 is exposed to the case of the ventilation system, the components of the electric heat exchanger module 110 can be more conveniently installed and replaced.

Like the first embodiment, the dehumidifier module and the filter module can be removed or added according to the selection of the user.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A ventilation system comprising:

a ventilation module positioned adjacent to an inside space and having a heat exchanger submodule;

an IAQ module positioned adjacent to an outside space for improving quality of air passing through the ventilation module, the IAQ module being structured to receive at least one of a filter submodule, a dehumidifier submodule, and a humidifier submodule, to receive two of said submodules simultaneously, as well as to receive all three of said submodules simultaneously; and a casing for guiding air that consecutively passes through the ventilation module and the IAQ module, the dehumidifier submodule and the humidifier submodule each being structured to be selectively independently mounted on and dismounted from the casing as integral units, an inside wall of the casing having an opening for admitting outside air to the inside space and an other opening for drawing inside air to the outside space, an outside wall of the casing having an opening for drawing outside air into the inside space and an other opening for exhausting inside air to the outside space, wherein the inside and outside walls of the casing define opposing walls of the ventilation system, wherein outside air being introduced into the inside space through the casing sequentially passes through the filter submodule, the dehumidifier submodule, the heat exchanger submodule, and the humidifier submodule and is then discharged to the inside space.

2. The ventilation system according to claim 1, wherein indoor air being exhausted to the outside space sequentially passes through the heat exchanger submodule and the dehumidifier submodule and is then discharged to the outside space.

3. The ventilation system according to claim 1, wherein the ventilation module includes an air exhaust fan for allowing inside air to pass through the IAQ module using an air pushing manner and an air supply fan for allowing outside air to pass through the IAQ module using an air suction manner, the exhaust fan and the supply fan being positioned within the ventilation module adjacent to an inside wall of the casing.

4. The ventilation system according to claim 3, wherein a space where the air supply fan is disposed and a space where the air exhaust fan is disposed are divided by a barrier rib, the barrier rib being provided with a circulation aperture through which a portion of the inside air that is being discharged to the outside space is returned to the space where the air supply fan is disposed.

5. The ventilation system according to claim 1, wherein the humidifier submodule is provided on an inside air discharge side of the IAQ module to add moisture to the air that is being discharged to the inside space.

6. The ventilation system according to claim 1, wherein the heat exchanger submodule is structured to be mounted onto and to be dismounted from the casing, independently of the other submodules.

7. The ventilation system according to claim 1, wherein the dehumidifier submodule comprises:

a desiccant configured to discharge moisture to the inside air that is being discharged to an outside space and to absorb moisture from outside air that is being introduced into the inside space;

a heater provided at an inlet side of the desiccant for heating the inside air that is being discharged, wherein a portion of the air that is being discharged is exhausted without passing through the heater.

* * * * *